US005579824A

United States Patent [19]

Itoyama et al.

[11] Patent Number: 5,579,824

[45] Date of Patent: Dec. 3, 1996

[54] CONTINUOUS CASTING PROCESS WITH VERTICAL MOLD OSCILLATION

[75] Inventors: Seiji Itoyama; Hirokazu Tozawa; Shuji Takeuchi; Kenichi Sorimachi, all of Chiba, Japan

[73] Assignee: Kawasaki Steel Corporation, Kobe, Japan

[21] Appl. No.: 602,258

[22] Filed: Feb. 16, 1996

Related U.S. Application Data

[63] Continuation of Ser. No. 81,313, filed as PCT/JP93/01205, Sep. 22, 1992, abandoned.

[51] Int. Cl.[6] ..... B22D 11/04; B22D 11/16

[52] U.S. Cl. ..... 164/478; 164/416

[58] Field of Search ..... 164/478, 416

[56] References Cited

U.S. PATENT DOCUMENTS

| | | | |
|---|---|---|---|
| 4,945,975 | 8/1990 | Sorimachi et al. | 164/478 |
| 5,299,627 | 4/1994 | Sorimachi et al. | 164/478 X |

FOREIGN PATENT DOCUMENTS

| | | | |
|---|---|---|---|
| 1-18553 | 1/1989 | Japan . | |
| 2-290656 | 11/1990 | Japan . | |
| 3-99756 | 4/1991 | Japan . | |
| 3-248746 | 11/1991 | Japan | 164/478 |
| 3-297546 | 12/1991 | Japan . | |
| 4-89163 | 3/1992 | Japan | 164/478 |
| 4-143057 | 5/1992 | Japan . | |

*Primary Examiner*—J. Reed Batten, Jr.
*Attorney, Agent, or Firm*—Dvorak and Traub

[57] ABSTRACT

In a process of withdrawing castings while vertically oscillating a mold formed with long side walls and short side walls, the long side walls are moved apart from the castings by operating a hydraulic cylinder in the time zones for which the castings are applied with a large frictional force. On the contrary, the separated long side walls are made to move together to the casting in the other time zones for which the casting is not applied with the large frictional force. By repeating the separation and approaching of the long side walls, it is possible to obtain castings which are reduced in the depths of oscillation marks and suppressed in segregations at oscillation mark trough portions.

4 Claims, 5 Drawing Sheets

CONTINUOUS CASTING PROCESS WITH VERTICAL MOLD OSCILLATION

This application is a continuation of application Ser. No. 08/081,313, filed as PCT/JP93/01205, Sep. 22, 1992, and now abandoned.

TECHNICAL FIELD

The present invention relates to a process for continuous castings, capable of obtaining castings with reduced depth oscillation marks and reduced in segregation at oscillation mark trough portions, by means of a continuous casting method, particularly, a vertical metal casting method.

BACKGROUND ART

Conventionally, for the purpose of eliminating the repaired work for the surfaces of continuous castings, there has been proposed a technique of oscillating a vertical mold for reducing or preventing positive segregations at oscillation mark trough portions on the surfaces of the castings, particularly, in casting stainless steel (SUS 304). For example, Japanese Patent Laid-open No. hei 2-290656 discloses a technique where, in a continuous casting mold of a type forming a casting space with two pairs of mold wall surfaces, a pair of the mold wall surfaces are relatively separated from each other only for a negative strip time zone in vertical oscillation or for a mold descending time zone.

This technique is recognized to be considerably effective as compared with a case of using only simple vertical oscillation. However, as a result of an experiment, it is seen that this technique is not much effective in a case where the oscillation frequency <f> of the mold is small. Further, in the above technique, the consumption of mold powder is reduced, thereby causing the breakout due to sticking. Accordingly, this is an obstacle for obtaining a stable casting.

Conventionally, the mechanism and cause of segregations at oscillation mark trough portions are considered as follows: negative pressure is generated within a liquid phase lubricating film between the mold and the solidified shell due to oscillation of the mold; and due to this negative pressure, the non-solidified and concentrated molten steel between dendrites of the solidified surface layer permeate onto the surface of the shell.

However, as a result of the examination on the segregated portions of the castings by the present inventors, it was discovered that segregation is generated in accordance with such a mechanism that the continuous growth of the solidified shell is obstructed by breaking of the shell due to a tensile force applied thereto and by buckling due to a compressive force. Thereby the concentrated liquid or molten metal flows out from the broken portions or buckled portions of the shell to the surface of the shell. Accordingly, to prevent the segregation, it is necessary to prevent the breaking or the buckling of the shell at the beginning of the solidification, that is, to simultaneously reduce the tensile force and the compressive force applied to the shell.

An object of the present invention is to provide a process of withdrawing the continuous castings wherein, even in the low cycle condition that the oscillation frequency <f> of the mold is small, the segregation at oscillation mark trough portions on the surfaces of the castings are significantly reduced to the degree equivalent to that in the high cycle condition, and also to provide stable castings.

DISCLOSURE OF THE INVENTION

In a preferred mode of the present invention, there is provided a casting process for continuous casting characterized by vertically oscillating a vertical continuous casting mold forming a casting space and having two pairs of mold wall surfaces; and simultaneously repeating a series of actions comprising separating at least a pair of mold wall surfaces from a solidified shell at any period in each specified time zone within a positive strip time zone and a negative strip time zone, and bringing the separated mold wall surfaces back and close to the solidified shell within the other time zones.

Further, preferably, there is provided a casting process for continuous castings characterized by performing the casting under the condition of only a positive strip time zone, while vertically oscillating a vertical continuous casting mold forming a casting space with two pairs of mold wall surfaces; and repeating a series of actions comprising separating at least a pair of mold wall surfaces from a solidified shell at one time in each specified time zone within a mold ascending period and a mold descending period, and bringing the separated mold wall surfaces back and close to the solidified shell within the other time zones in the mold ascending period and the mold descending period.

BEST MODE FOR CARRYING OUT THE INVENTION

Figure 1:
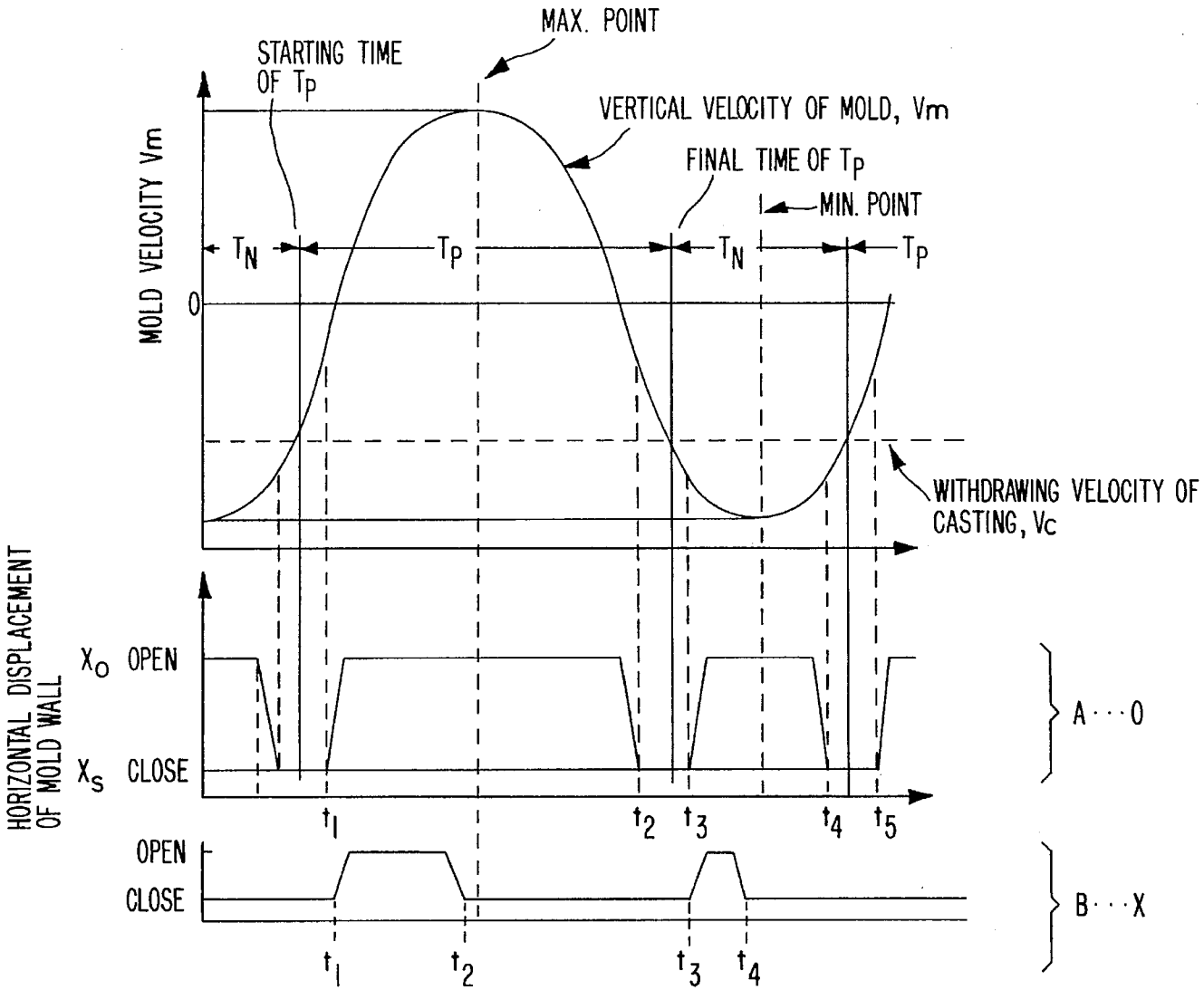
FIG. 1 is a graph showing the changes in the vertical oscillating velocity of a mold and the horizontal displacement of the mold walls with time according to an embodiment of the present invention.

As shown in FIG. 1, when a mold reaches the uppermost point, the vertical velocity Vm of the mold becomes 0. Subsequently, as the mold starts its descent, the velocity Vm is gradually increased. When the mold reaches the lowermost point, the velocity Vm again becomes 0. When the mold starts to ascend again, the velocity Vm of the mold is increased. Also, in terms of the relative relationship between the vertical velocity of the mold and the withdrawing velocity Vc of the casting, the time for which the vertical velocity Vm of the mold is smaller than the withdrawing velocity Vc is referred to as negative strip time $T_N$.

In vertical oscillation of the mold as shown in FIG. 1, at any period in a time zone from the time t1 to t2 for which the relative velocity Vm is larger than velocity Vc within a positive strip time Tp for which the solidified shell is applied with a tensile force, at least a pair of mold walls are horizontally distracted in a manner to be relatively separated from the solidified shell, to be thus opened at the position of Xo. In absence of the negative strip time $T_N(T_N=0)$, as shown in FIG. 2, at one time in a time zone from the time t14 to t15 for which the relative velocity Vm is larger than the velocity Vc within a mold ascending time, at least a pair of mold walls are retracted in a manner to be relatively separated from the solidified shell, to be thus opened at the position of Xo.

Figure 6:
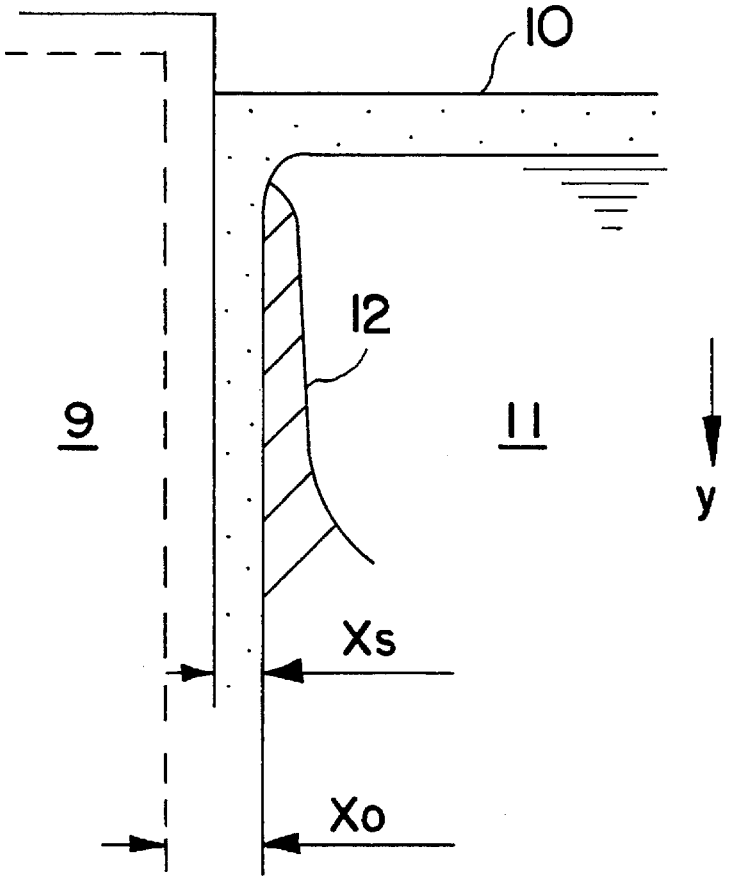
FIG. 6 is a view showing the portion between the mold wall and the solidified shell.

Thus, as shown in FIG. 6, a distance between a mold wall 9 and a solidified shell 12 is increased from Xs to Xo, so that a mold powder 10 on a molten steel 11 is made to sufficiently flow in a gap between the mold wall 9 and the solidified shell 12 to thereby reduce the frictional force between the mold wall 9 and the solidified shell 12. In addition, the arrow of Y indicates the direction of withdrawing the casting.

In FIG. 1, at one time in a subsequent time zone from the time t3 to t4 for which the relative velocity is smaller within the negative strip time $T_N$ for which the compressive force is applied to the shell, the mold walls are relatively separated from the solidified shell, to be thus opened at the position of Xo. In absence of no negative strip time $T_N(T_N=0)$, as shown in FIG. 2, at one time in a time zone from the time t12 to t13 for which the relative velocity is smaller in a mold descending time, at least a pair of mold walls are retracted in a manner to be relatively separated from the solidified shell, to be thus opened at the position of Xo. In absence of the negative strip, since the relative velocity between the mold and the solidified shell is usually directed upwardly, it is considered that the shell is subject to compressive force. However, since the solidified shell at the meniscus portion within the mold is continuously grown and the position thereof is made constant, the shell is subject to compressive force even in the case of $T_N=0$.

Figure 2:
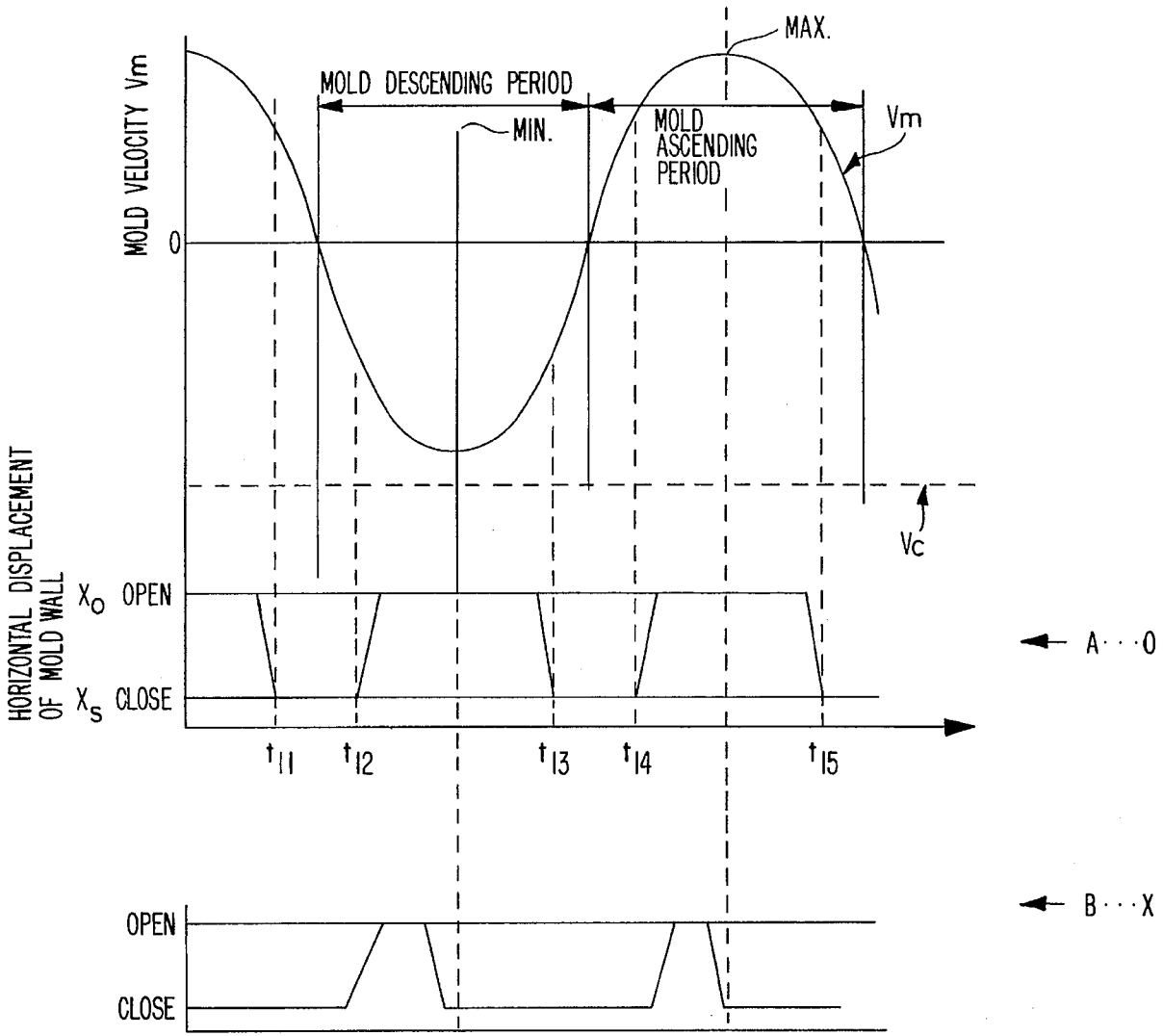
FIG. 2 is a graph showing the changes in the vertical oscillating velocity of a mold and the horizontal displacement of the mold walls with time according to another embodiment of the present invention.

For the time zones other than those described above, that is, for the time zones from the time t2 to t3 and from the time t4 to t5 in FIG. 1, and the time zones from the time t1 to t2 and from the time t13 to t14 in FIG. 2, the mold walls are advanced toward each other to be close to the solidified shell, to be thus closed at the position of Xs. The distance X between the mold and the solidified shell is changed from Xo to Xs. When providing horizontal oscillation to the mold for changing the distance between the mold wall surfaces and the solidified shell, the frictional force applied to the initial solidified shell of the meniscus portion can be calculated, taking into account the frictional force between the mold and the solidified shell. The shear force applied between the mold and the solidified shell is determined by the following equation:

$$F=A\times\mu(dV/dX) \quad (1)$$

wherein

A: contact area between mold and solidified shell

μ: viscosity of mold powder flown in space between mold wall and solidified shell dV: relative velocity between mold wall and solidified shell (=Vm−Vc)

X: distance between mold and solidified shell

As is apparent from the above equation (1), the frictional force F applied to the solidified shell is reduced at the period for which the distance X between the mold and the solidified shell is enlarged. Namely, according to the present invention, it is possible to significantly reduce the tensile force and the compressive force applied to the shell of the meniscus portion at the beginning of the solidification.

Consequently, the continuity of the solidified shell is held, thereby making it possible to narrow the depths of the oscillation marks, and to reduce the possibility of generating segregation at the oscillation mark trough portions as compared with the conventional technique.

The effect described above is not much dependent on the vertical oscillation waveform and a waveform for horizontally advancing/retarding (closing/opening) the mold walls (hereinafter, referred to as "horizontal oscillation"), and which is similarly effective in the cases of the non-sinusoidal wave or triangular wave other than the vertical oscillation of the sinusoidal wave and the horizontal wave of the trapezoidal wave as shown in FIG. 1. In addition, to prevent molten steel from permeating in the gaps at the mold corners thereby bringing about undesirable sticking induced breakout, the amplitude of the horizontal oscillation is preferably within the range of 1 mm or less.

Hereinafter, the present invention will be described in detail with reference to examples.

EXAMPLE 1

Figure 3:
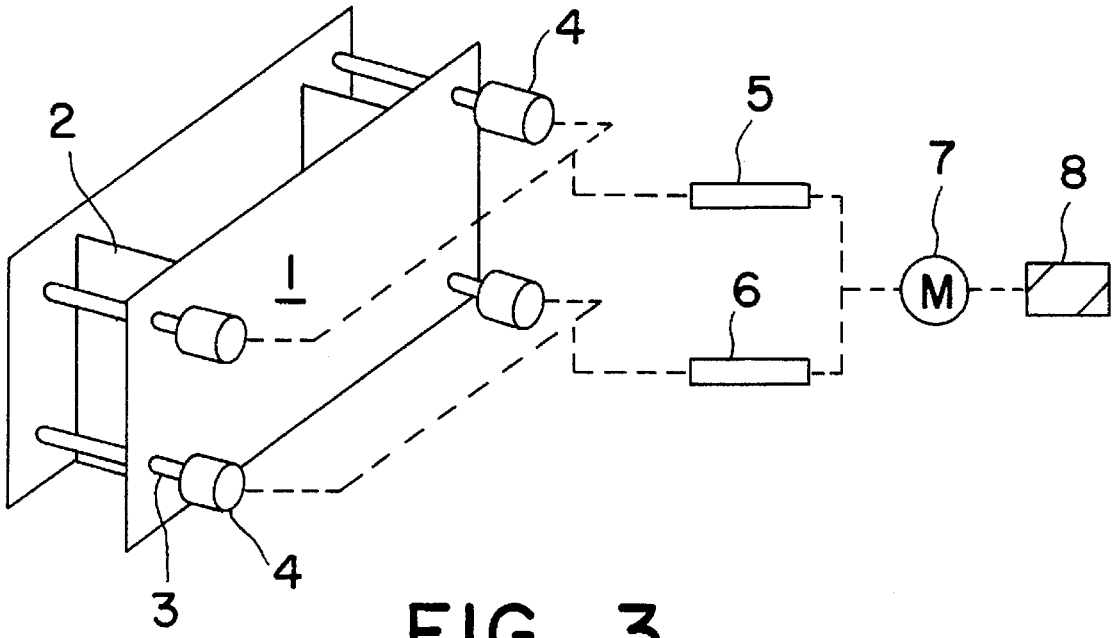
FIG. 3 is a schematic perspective view showing a mold horizontal moving apparatus used in the embodiments of the present invention.

As shown in FIG. 3, a horizontal oscillator generally used for a slab continuous casting machine has a mechanism for clamping mold short sides 2 with mold long sides 1 through short side clamping springs 3. In the present invention, there is provided a hydraulic circuit for opening/closing a short side clamping hydraulic cylinder 4, so that the long sides 1 of the mold is moved by opening and closing the short side clamping hydraulic cylinder 4 through upper and lower solenoid valves 5 and 6 provided in a hydraulic circuit. Numeral 7 indicates a hydraulic motor and numeral 8 is a hydraulic tank. If the gaps between the long sides and short sides of the mold are made excessively larger, molten steel permeates into the gaps, thereby causing trouble. Accordingly, the retracted amount of the long sides of the mold is within the range of 1 mm or less.

Figure 4:
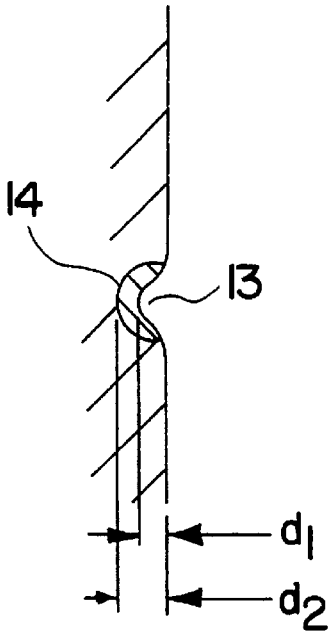
FIG. 4 is a view showing an oscillation mark and a segregated layer.
Figure 5A:
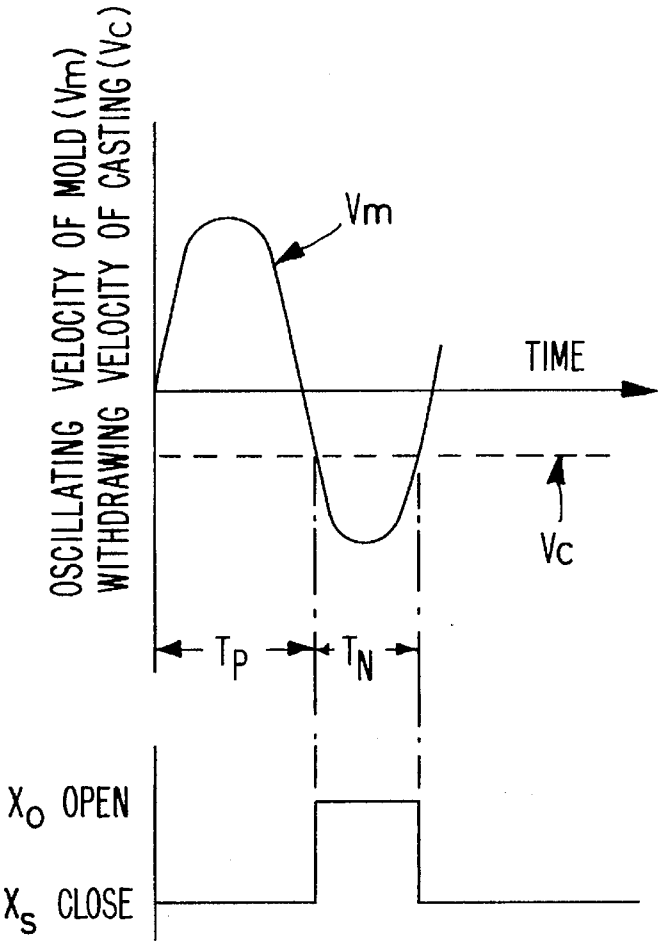
FIG. 5(a) PRIOR ART
FIGS. 5(*a*) and 5(*b*) are graphs showing an oscillation waveform of the prior art mold, and the retarding and advancing timings thereof.
Figure 5B:
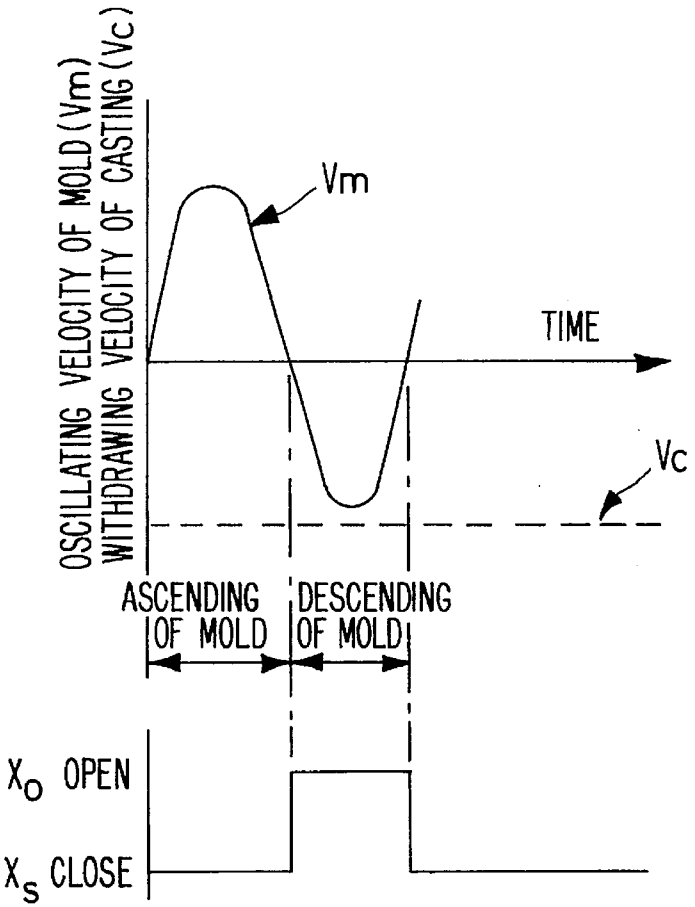
FIG. 5(b) PRIOR ART

The casting of stainless steel (SUS 304) was continuously cast using the above horizontal oscillator for horizontally oscillating the mold walls as shown in FIG. 3. In the above casting, from the depth $d_1$, at an oscillation mark 13 (see FIG. 4) and the segregation layer depth d2 at the segregation mark portion on the surface of the casting, the segregation layer thickness (d2–d1) at the oscillation mark portion was obtained. Thus, the examination was made for the above segregation layer thickness (d2–d1) and the segregation layer depth d2. For comparison, the examinations were made for the cases involving only the vertical oscillation (sinusoidal wave) according to the conventional manner; and of cases involving oscillating waves as shown in FIGS. 5(*a*) and 5(*b*) disclosed in Japanese Patent Laid-open No. Hei 2-290656. In the above, FIG. 5(*a*) shows the case of moving the mold walls backward during the period when the oscillation of the mold lies in the negative strip time. Besides, FIG. 5(*b*) shows the case of retracting the mold in the mold descending period. In addition, the casting condition of the present invention is as follows: withdrawing velocity Vc of castings=1.2/min; mold vertical oscillating frequency f=150 times/min; amplitude S=5.3 mm; vertical oscillating waveform =sinusoidal curve; horizontal oscillating amplitude =0.3 mm; horizontal oscillating pattern is trapezoidal wave (see FIG. 1). Further, the mold wall opening/closing timing is closed (at the position of Xs) for a period from 105° to 130° (from the time t2 to t3 in FIG. 1) in terms of angle conversion (zero angle, when Vm is positively maximized), and a period from 240° to 275° (from the time t4 to t5 in FIG. 1), and is opened (at the position of Xo) for the other periods. The moving velocity from the opening to the closing, or the closing to the opening was specified at 50 mm/sec. In addition, as the mold powder, there was used a lubricant having a viscosity of 1.1 poise at 1300° C. and the solidification temperature of 900° C.

EXAMPLE 2

Next, for the case of no negative strip time ($T_N$=0), the test was carried out in the same manner as in Example 1, except that the amplitude S of the mold vertical oscillation was 2.0 mm, and the horizontal opening and closing timing was closed in the period from 110° to 160° (from the time t11 to t12 in FIG. 2) and in a period from 250° to 290° (from the time t13 to t14 in FIG. 2), and was opened in the other periods.

The results obtained in Examples 1 and 2 are shown in Table 1 as compared with the conventional manner. It becomes apparent from Table 1 that, as compared with the conventional manner, the present invention makes it possible to significantly reduce the rate of generating segregations at the oscillation trough portions to almost zero.

TABLE 1

| | | Vertical oscillation of mold | | | Segregation | | | |
|---|---|---|---|---|---|---|---|---|
| | | | | | Thickness | Generation | Oscillation mark | |
| No. | Oscillation Type | Amplitude (mm) | Frequency (cpm) | Condition of horizontal oscillation | $d_2 - d_1$ (mm) | rate (%) | depth $d_2$ (mm) | Remark |
| 1 | Conventional | 5.3 | 150 | Horizontal oscillation, not applied | 0.35 | 67 | 0.42 | $T_N > 0$ |
| | | 2 | 300 | Horizontal oscillation, not applied | 0.10 | 25 | 0.15 | $T_N > 0$ |
| 2 | Conventional | 5.3 | 150 | Open in negative period | 0.20 | 43 | 0.37 | $T_N > 0$ |
| 3 | Conventional | 2 | 150 | Open in mold descending period | 0.18 | 34 | 0.32 | $T_N = 0$ |
| 4 | Present invention | 5.3 | 150 | Condition of present invention (see FIG. 1) | 0 | 0 | 0.21 | $T_N > 0$ |
| 5 | Present invention | 2 | 150 | Condition of present invention (see FIG. 2) | 0 | 0 | 0.15 | $T_N = 0$ |

Industrial Applicability

By provision of a mold oscillation method of horizontally opening and closing (retracting and advancing) the mold walls from and to the solidified shell according to the mold vertical oscillating timing for extremely reducing the compressive force and the tensile force applied to the initial solidified shell, it is possible to significantly reduce segregations at the oscillation trough portions on the surface of the casting. As a result, the following effects can be obtained:

(1) By eliminating the need of performing the casting under the high cycle mold oscillating condition with a fear of causing the generation of sticking induced breakout, it is possible to reduce the trouble in productivity.

(2) In the case of stainless steel (SUS 304), since it is possible to reduce the amount to be cut by a grinder for removing the segregations before the heating and rolling processes as in the conventional manner, and further to supply the casting to the next process with no repairing in the specific case, an improvement in yield can be expected.

We claim:

1. A method for continuous vertical casting of molten metal through a mold so as to form a casting having an outer surface in the form of a solidified metallic shell, said mold having a casting space formed by a first pair of opposed walls and a second pair of opposed walls, said first and second walls being perpendicular to each other and in contact with said shell, one of said first and second pairs of opposed walls movable towards and away from each other and from contact with said shell, the method comprising the steps of:

vertically and cylindrically oscillating said mold so as to define a mold ascending travel period and a mold descending travel period, said ascending travel period corresponding to a period of time said mold requires to upwardly travel from a lowermost oscillation point to an uppermost oscillation point, and said descending travel period corresponding to a successive period of time said mold requires to downwardly travel from said uppermost oscillation point back to said lowermost oscillation point, said mold having a maximum upward velocity during said ascending travel period corresponding to a midpoint between said uppermost and uppermost oscillation points, and said mold having a maximum downward velocity during said descending travel period corresponding to a midpoint between said uppermost and lowermost oscillation points, said uppermost and lowermost points corresponding to a mold position where said mold velocity is zero due to said mold changing between an upwardly and downwardly travel direction, wherein said mold vertical velocity during successive ascending and descending travel periods defines a positive time strip and a negative time strip, said positive and negative time strips each defining a relationship between the vertical velocity of said mold and a withdrawal velocity of said casting, each of said positive and negative time strips having a starting time and a finishing time, said starting time of said positive time strip corresponding to a finishing time of said negative time strip and said finishing time of said positive time strip corresponding to a starting time of said negative time strip, each of said starting and finishing times of said positive and negative time strips corresponding to a point where said mold has a speed equivalent to a speed of said casting and where a relative velocity between said mold and said casting is zero, said positive time strip defined as a period of time within said ascending and descending travel periods wherein said mold vertical velocity is relatively greater than said withdrawal velocity of said casting and said negative time strip defined as a period of time within said ascending and descending travel periods wherein said mold vertical velocity is relatively less than said withdrawal velocity of said cast metal;

retracting said movable walls away from each other and from contact with said shell when said mold vertical velocity is operably within said positive time strip, said walls being opened at a first period of time corresponding to where said mold vertical velocity is between that of said starting point of said positive time strip and that of said mold maximum vertical velocity within said positive time strip, said movable walls being closed towards each other and into contact with said shell at a second period of time corresponding to where said mold vertical velocity is between that of said maximum vertical velocity within said positive time strip and that of said finishing point of said positive time strip, said opening and closing of said walls at said first and second periods of time occurring at equal velocities within said positive time strip; then retracting said movable walls away from each other and from contact with said shell when said mold vertical velocity is operably within said negative time strip, said walls being opened at a third period of time corresponding to where said mold vertical velocity is between that of said starting point of said negative time strip and that of said mold maximum vertical velocity within said negative time strip, said movable walls being closed towards each other and into contact with said shell at a fourth period of time corresponding to where said mold vertical velocity is between that of said maximum vertical velocity within said negative time strip and that of said finishing point of said negative time strip, said opening and closing of said walls at said third and fourth periods of time occurring at equal velocities within said negative time strip.

2. The method of continuously vertical casting molten metal of claim 1, further including the step of injecting a mold powder between said movable mold walls and said shell of said casting when said mold walls are retracted, thereby reducing the frictional force between said movable mold walls and said shell.

3. A method for continuous vertical casting of molten metal through a mold so as to form a casting having an outer surface in the form of a solidified metallic shell, said mold having a casting space formed by a first pair of opposed walls and a second pair of opposed walls, said first and second walls being perpendicular to each other and in contact with said shell, one of said first and second pairs of opposed walls movable towards and away from each other and from contact with said shell, the method comprising the steps of:

vertically and cylindrically oscillating said mold so as to define a mold ascending travel period and a mold descending travel period, said ascending travel period corresponding to a period of time said mold requires to upwardly travel from a lowermost oscillation point to an uppermost oscillation point, and said descending travel period corresponding to a successive period of time said mold requires to downwardly travel from said uppermost oscillation point back to said lowermost oscillation point, said mold having a maximum upward velocity during said ascending travel period corresponding to a midpoint between said uppermost and uppermost oscillation points, and said mold having a maximum downward velocity during said descending travel period corresponding to a midpoint between said uppermost and lowermost oscillation points, said uppermost and lowermost points corresponding to a mold position where said mold velocity is zero due to said mold changing between an upwardly and downwardly travel direction, said casting having a downward direction and a constant withdrawal velocity, said ascending travel period having a portion thereof wherein said mold has a vertical velocity that is greater than said withdrawal velocity of said casting and said descending travel period having a portion thereof wherein said mold has a vertical velocity that is greater than said withdrawal velocity of said casting;

retracting said movable walls from each other and from said casting shell when said mold vertical velocity is operable during said portion of said ascending travel period where said vertical velocity of said mold is greater than said withdrawal velocity of said casting;

and retracting said movable walls from each other and from said casting shell when said mold vertical velocity is operable during said portion of said descending period where said vertical velocity of said mold is greater than said withdrawal velocity of said casting.

4. The method of continuously vertical casting molten metal of claim 3, further including the step of injecting a mold powder between said movable mold walls and said shell of said casting when said mold walls are retracted, thereby reducing the frictional force between said movable mold walls and said shell.

* * * * *

UNITED STATES PATENT AND TRADEMARK OFFICE

CERTIFICATE OF CORRECTION

PATENT NO. : 5,579,824

DATED : Dec. 3, 1996

INVENTOR(S) : Itoyama, et al

It is certified that error appears in the above-indentified patent and that said Letters Patent is hereby corrected as shown below:

On cover page, item [21], "602,258" to --602,268--

Signed and Sealed this

Twentieth Day of May, 1997

*Attest:*

*Attesting Officer*

Bruce Lehman

BRUCE LEHMAN

*Commissioner of Patents and Trademarks*